US010568465B2

(12) United States Patent
Fusco et al.

(10) Patent No.: US 10,568,465 B2
(45) Date of Patent: Feb. 25, 2020

(54) BATH SEAT

(71) Applicant: SUMMER INFANT (USA), INC., Woonsocket, RI (US)

(72) Inventors: Michael Thomas Fusco, Greenville, RI (US); Christopher C. Briden, Coventry, RI (US); Anthony Carbone, Attleboro, MA (US); Zachary R. Stebenne, Wyoming, RI (US); Mark J. Sousa, Hope, RI (US); Spencer P. Brown, Providence, RI (US)

(73) Assignee: Summer Infant (USA) Inc., Woonsocket, RI (US)

( * ) Notice: Subject to any disclaimer, the term of this patent is extended or adjusted under 35 U.S.C. 154(b) by 0 days.

(21) Appl. No.: 15/592,576

(22) Filed: May 11, 2017

(65) Prior Publication Data

US 2018/0325324 A1 Nov. 15, 2018

(51) Int. Cl.
*A47K 3/12* (2006.01)

(52) U.S. Cl.
CPC ..... *A47K 3/122* (2013.01); *A47K 3/127* (2013.01)

(58) Field of Classification Search
CPC ..... A47K 3/122
USPC ..... 4/579
See application file for complete search history.

(56) References Cited

U.S. PATENT DOCUMENTS

| | | | | |
|---|---|---|---|---|
| 5,010,606 | A | 4/1991 | Bernstein | |
| 5,318,262 | A | 6/1994 | Adams | |
| 5,335,377 | A | 8/1994 | Masyada et al. | |
| 5,687,433 | A | 11/1997 | Garner | |
| 6,314,592 | B1 * | 11/2001 | Stein | A47K 3/127 4/572.1 |
| 6,457,190 | B1 | 10/2002 | Stein | |
| 7,455,269 | B1 | 11/2008 | Chien | |
| 7,661,638 | B2 * | 2/2010 | Yu | F16B 47/00 248/205.5 |
| 8,104,809 | B1 | 1/2012 | Mayhugh | |
| 8,151,383 | B2 | 4/2012 | Feener | |
| 9,867,479 | B2 † | 1/2018 | Kaplan | |
| 2014/0182057 | A1 | 7/2014 | Saidman | |

FOREIGN PATENT DOCUMENTS

| | | | |
|---|---|---|---|
| CN | 103974649 | A | 8/2014 |
| DE | 2639746 | A1 | 3/1978 |
| GB | 699002 | | 10/1953 |
| GB | 2455616 | | 6/2009 |
| GB | 2463325 | | 8/2010 |
| GB | 2476939 | | 5/2012 |
| GB | 2463324 | B | 10/2013 |
| RU | 2285159 | C2 | 10/2006 |

OTHER PUBLICATIONS

International Search Report and Written opinion received in International Application No. PCT/US2018/031777, dated Sep. 6, 2018, 7 pages.

* cited by examiner
† cited by third party

*Primary Examiner* — Lauren A Crane
(74) *Attorney, Agent, or Firm* — Adler Pollock & Sheehan P.C

(57) ABSTRACT

An improved bath seat for a young child or infant is provided. The bath seat has a plurality of rigid, extendable and retractable, stabilizing arms that include pivotable, spring-loaded suction cups at or near their ends that are engageable by means of suction with a wall of the bathtub to prevent the bath seat from tipping.

19 Claims, 15 Drawing Sheets

FIG. 5
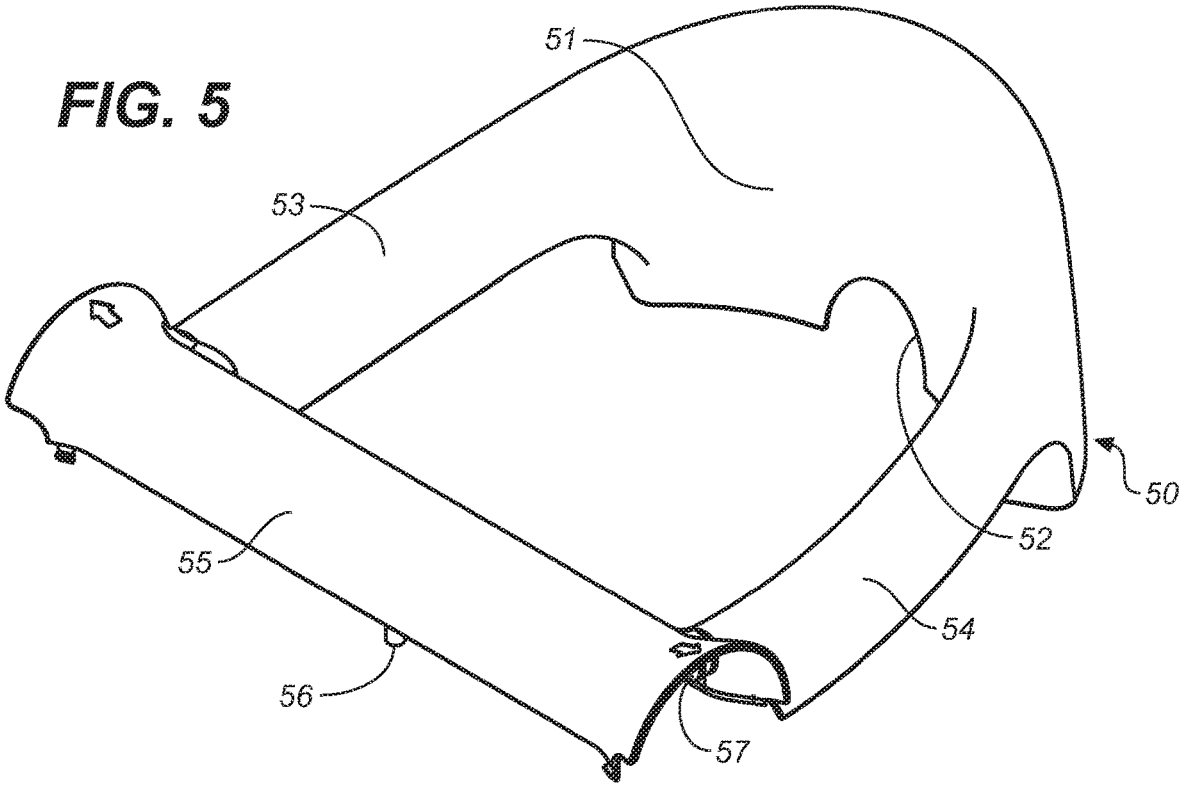
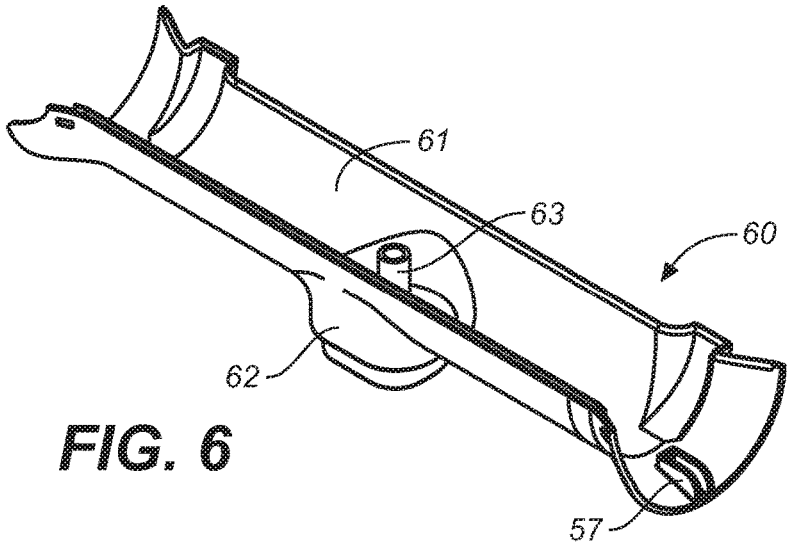
FIG. 6

FIG. 17
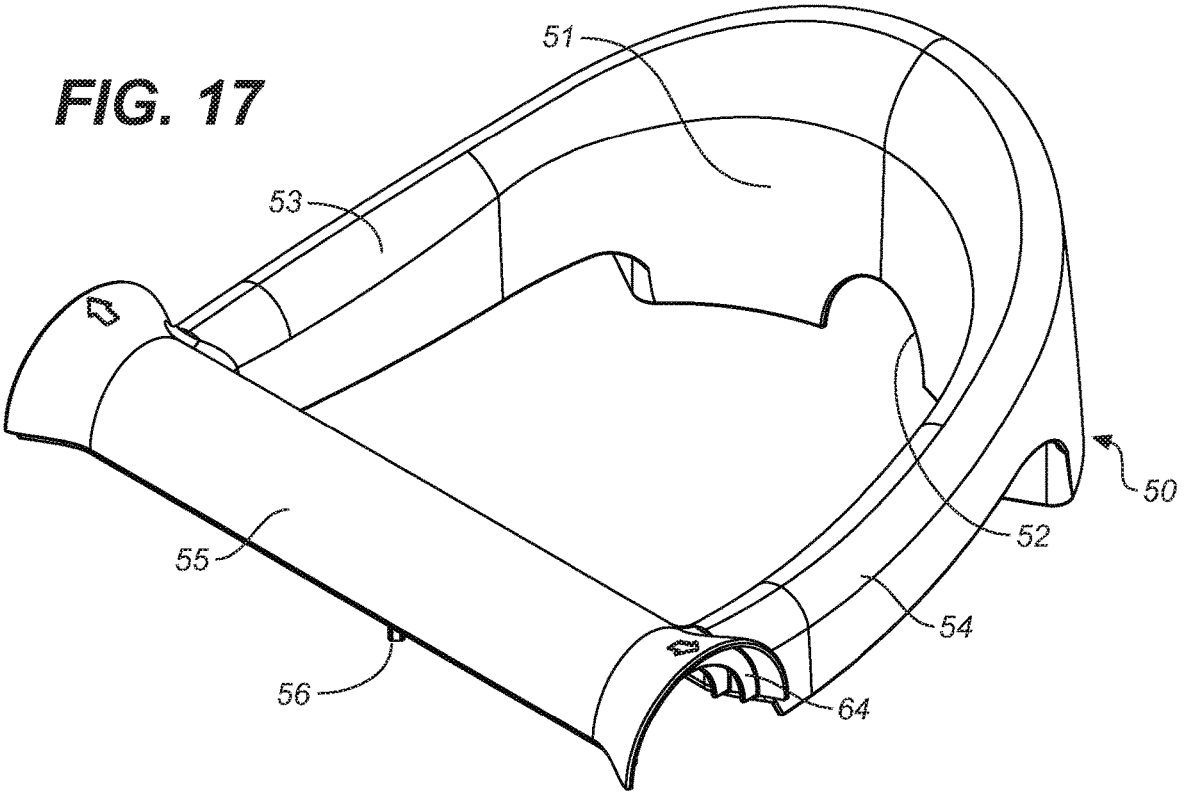
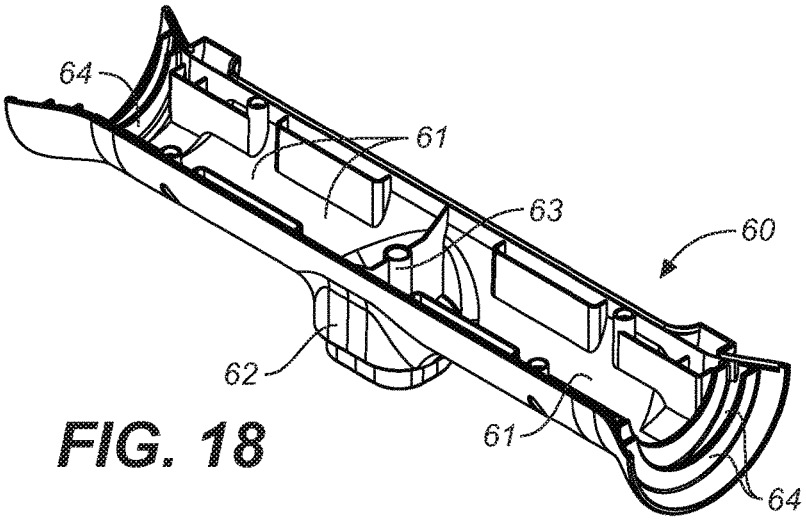
FIG. 18

FIG. 19
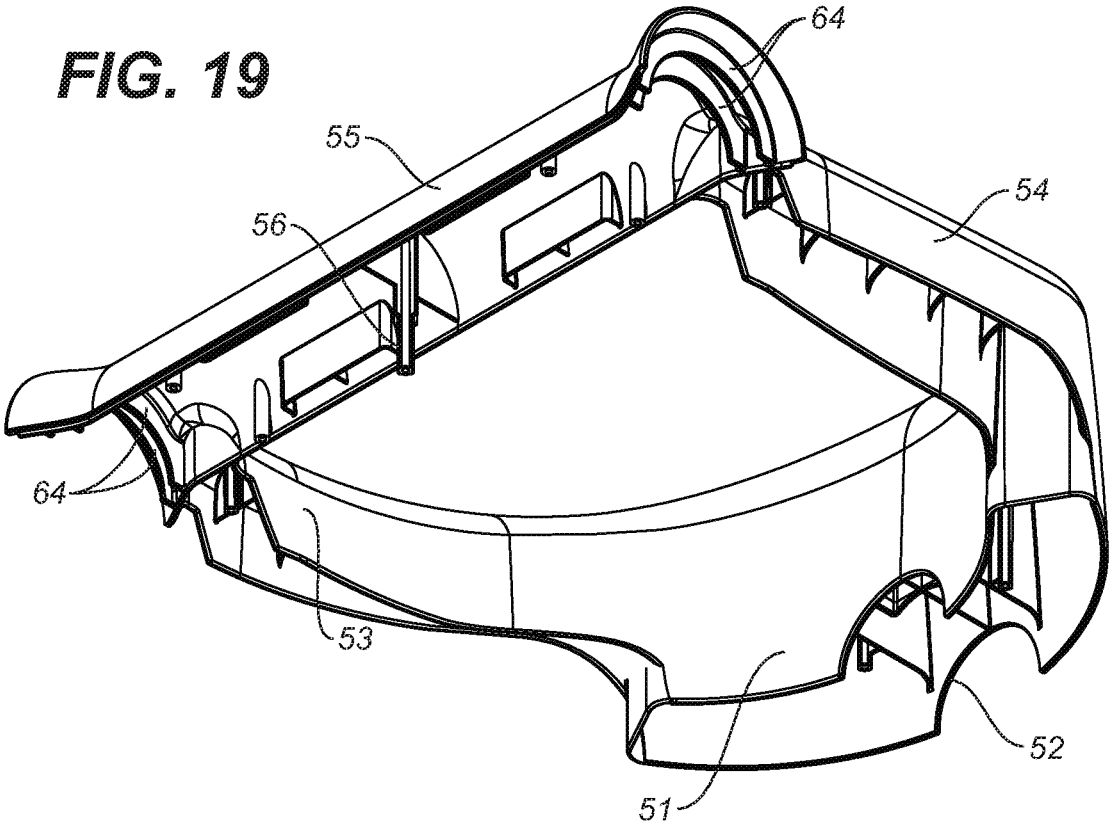
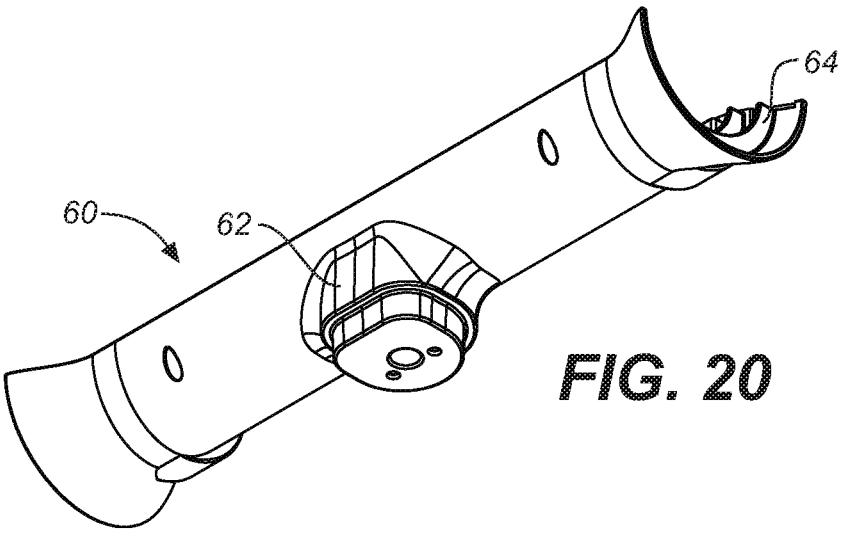
FIG. 20

BATH SEAT

FIELD OF THE INVENTION

This invention related to bath seats that are adapted to mount in a bath tub and hold a young child or a baby in a secure position for bathing.

BACKGROUND OF THE INVENTION

Bathing young children and babies who are not capable of supporting themselves can be challenging. One can bath with the baby and hold the baby in one's lap, or one can lean over the tub side and hold the baby with one hand while soaping and rinsing with the other, which can be difficult because constant support is required to keep the baby or young child safe.

Support devices that seat the child or baby have been developed to make bathing such young persons safer and to permit the bath giver use of both arms and hands during the bathing process. U.S. Pat. No. 5,010,606 issued Apr. 30, 1991 (Bernstein et al.) discloses one such device and discusses a number of others. The device disclosed in the '606 patent has a seat base that is secured to the tub bottom by means of suction cups, a generally circular frame which rotates on the base and is formed with a seat back and arms that extend and meet in the front of the device, and a series of support posts that position the frame above the seat base and provide open areas through which the child's legs can extend. U.S. Pat. No. 5,687,433 issued Nov. 18, 1997 (Garner et al.) discloses a similarly constructed device that has a removable tray and a strut that extends between the suction cupped base and the tray to support the tray and to prevent a child from slipping under the tray. U.S. Pat. Nos. 6,314,592 and 6,457,190 issued Nov. 13, 2001 and Oct. 1, 2002 respectively (Stein) disclose a bath seat having a base and a frame that forms a generally triangular aperture with a plurality of support members extending between the base and the frame. The triangular aperture is said to provide a limit on the child's range of motion while still allowing the child to be easily seated. Suction cups are either affixed to the bottom of the base or attached to flexible nylon tether lines that are removably connected to a support member by a clip. U.S. Pat. No. 8,151,383 issued Apr. 10, 2012 (Feener) discloses a baby bath seat with a seat mounting bracket configured to be mounted on a rim of a bath tub. United States Patent Publication No. 2014/0182057 discloses a bath seat having a suction cupped base and an inflatable superstructure composed of a seat back, and a ring supported by inflatable struts. UK Patent Application GB 2 455 616 A discloses a removable, adjustable and lockable bath platform for an adult having a pair of suction cups engageable with the sides of the bath for holding the seat in place. UK Patent GB2476939 B discloses a bath seat for an adult having suction cups on its lower surface and extendable stabilizing members that engage the sides of a bath tub. UK Patent GB 2463324 B discloses a specific kind of suction cup usable with a bath seat that allows for easy removal and replacement.

Some of the bath seats for young children and babies that have bases with suction cups on the bottom, back and arm supports and trays with supporting struts have been recalled due to drowning hazards because the weight of the child can cause the device to tip over despite the suction cupped bottom. For this reason, the U.S. Consumer Product Safety Commission (CPSC) approved a new federal safety standard for infant bath seats. The new federal requirements for infant bath seats in ASTM F1967-13 add stricter stability requirements to prevent the bath seat from tipping over and tighter leg opening requirements to prevent children from slipping through the leg openings, among other things. The federal standard incorporates current voluntary standard provisions requiring latching and locking mechanisms, and compliance with CPSC's standards for sharp points and edges, small parts, and lead in paint.

Consequently, there is a need for a bath seat capable of meeting these stricter standards. This invention is intended to meet that need.

SUMMARY OF THE INVENTION

Disclosed is a bath seat usable in a bathtub that has a base, a seat top portion, and a plurality of support members, or stanchions, circumferentially disposed and extending between the base and the top portion. The seat top portion of the bath seat is, together with the bath seat base forms a couple of apertures to permit the legs of the user to extend therethrough.

The bath seat has a plurality of rigid, extendable and retractable, stabilizing arms that are retained by the bath seat. Each arm is independently extendable and retractable. It is preferred that the seat has three arms, two arms extendable from each side of the seat and one arm extendable from the back of the seat. However, other configurations can be envisioned with minimal effort. For example, another three arm configuration could have each rigid arm equidistant of each other. A four armed configuration could have rigid arms positioned and extendable from the left and right top and left and right back of a seat with a squarish, or rectangular, or oval shape. Each arm has a suction cup at or near one end thereof engageable by means of suction with a wall of the bathtub. Either the arm or arms are rotatable or the suction cup attached to one end of the arm or arms is rotatable. The rotation may be in one, two or three planes. The suction cups attached to the arms may be spring loaded and connected to arm by means of a ball joint or a hinge. The bottom of the bath seat may also have one or more suction cups.

BRIEF DESCRIPTION OF THE DRAWINGS

FIG. 5 is a perspective view of the seat top of the embodiment shown in FIG. 1.

FIG. 6 is a perspective view of the yoke portion of the seat top of the embodiment shown in FIG. 1.

FIG. 17 is perspective view of the seat top of the embodiment shown in FIG. 14.

FIG. 18 is a perspective view of the yoke portion of the seat top of the embodiment shown in FIG. 14.

FIG. 19 is a perspective view of the underside of the seat top of the embodiment shown in FIG. 14.

FIG. 20 is a perspective view of the underside of the yoke portion of the seat top of the embodiment shown in FIG. 15.

DETAILED DESCRIPTION

FIGS. 1-13 shows one embodiment of the bath seat of the invention and FIGS. 14-21 show another embodiment of the bath seat of the invention. In both embodiments, the bath seat has a molded, rigid, plastic seat with three rigid, independently movable, extendable and retractable arms that secure the whole assembly within a bathtub when extended to provide a stable platform for bathing a child. The arms are adjustable (extendible and retractable) to fit a range of tub widths, for example widths between 17.5 inches and 25 inches. Each arm terminates in a pivotable suction cup at one end and is held in place in the seat itself at the other end. In addition, the suction cup is spring-loaded to a more secure attachment to the tub wall. The two embodiments show different constructions of the side arm assemblies of the bath seat. Because the side arm assemblies differ. The parts of the bath seat enclosing the side arm assemblies differ as well. The rear arm assembly can take the structure of either of the side assembly embodiments.

Figure 1:
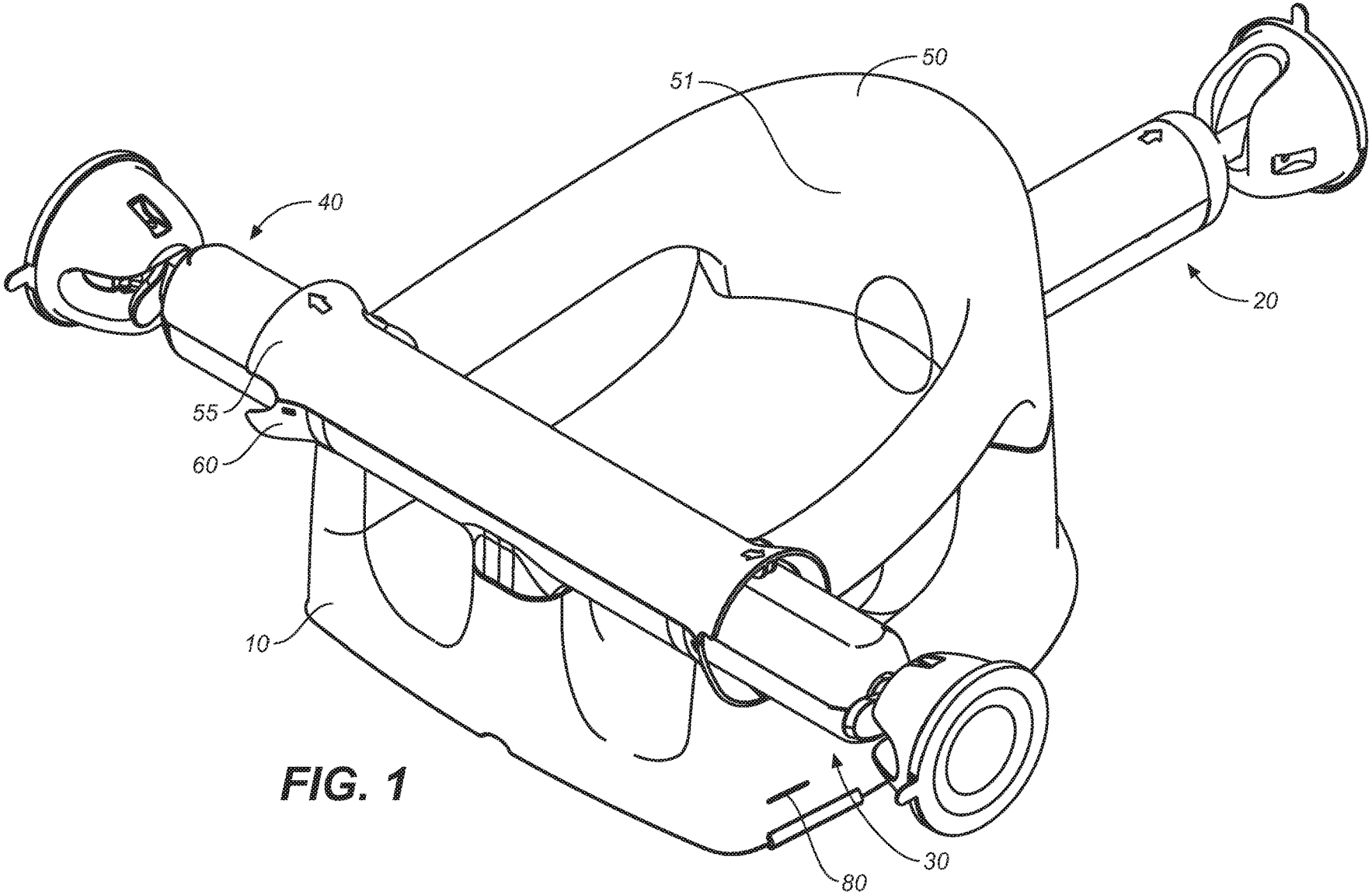
FIG. 1 is a perspective view of an embodiment of the invention with the extendable retractable arms in the extended position.
Figure 2:
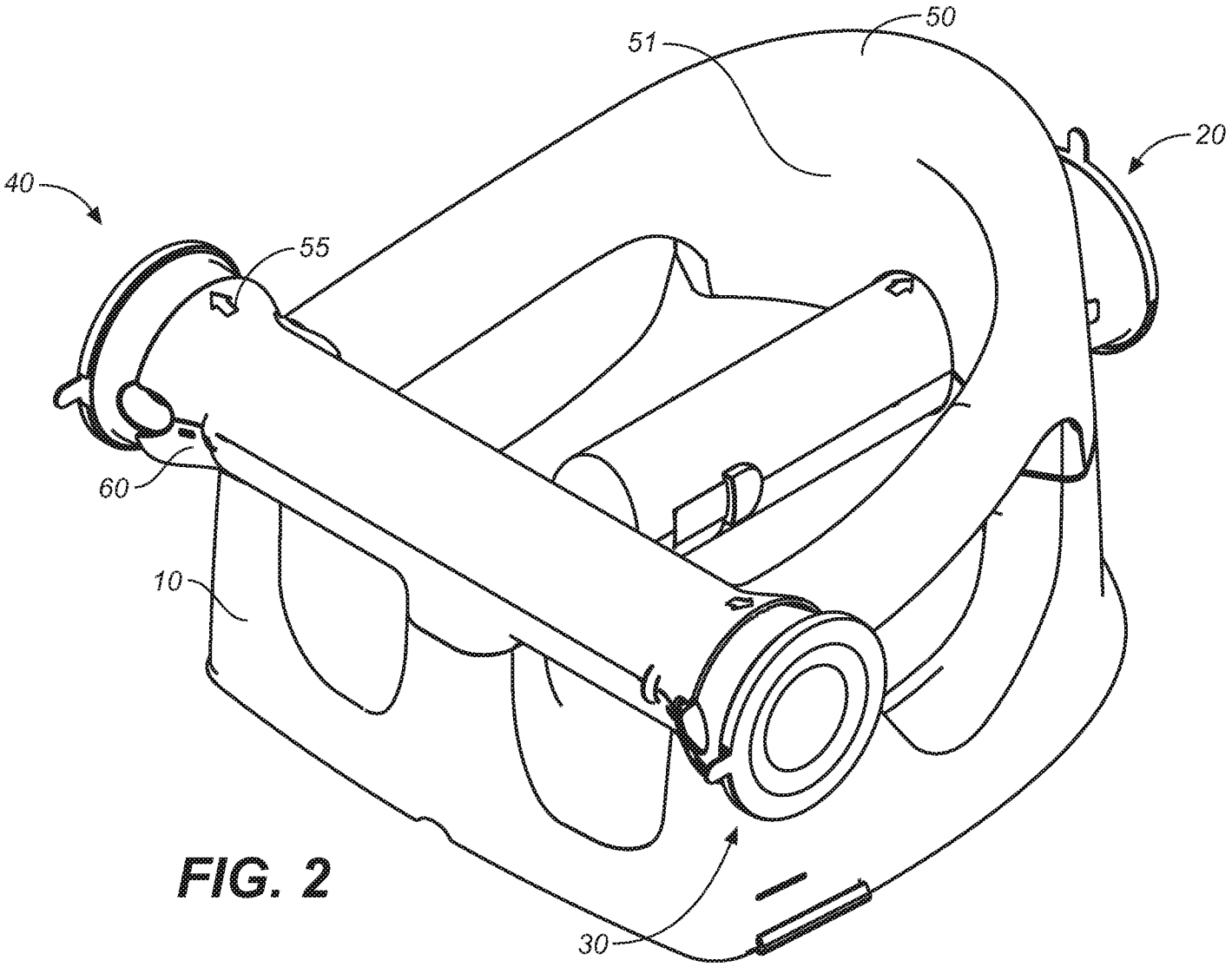
FIG. 2 is a perspective view of the embodiment shown in FIG. 1 with the same arms in the retracted position.
Figure 3:
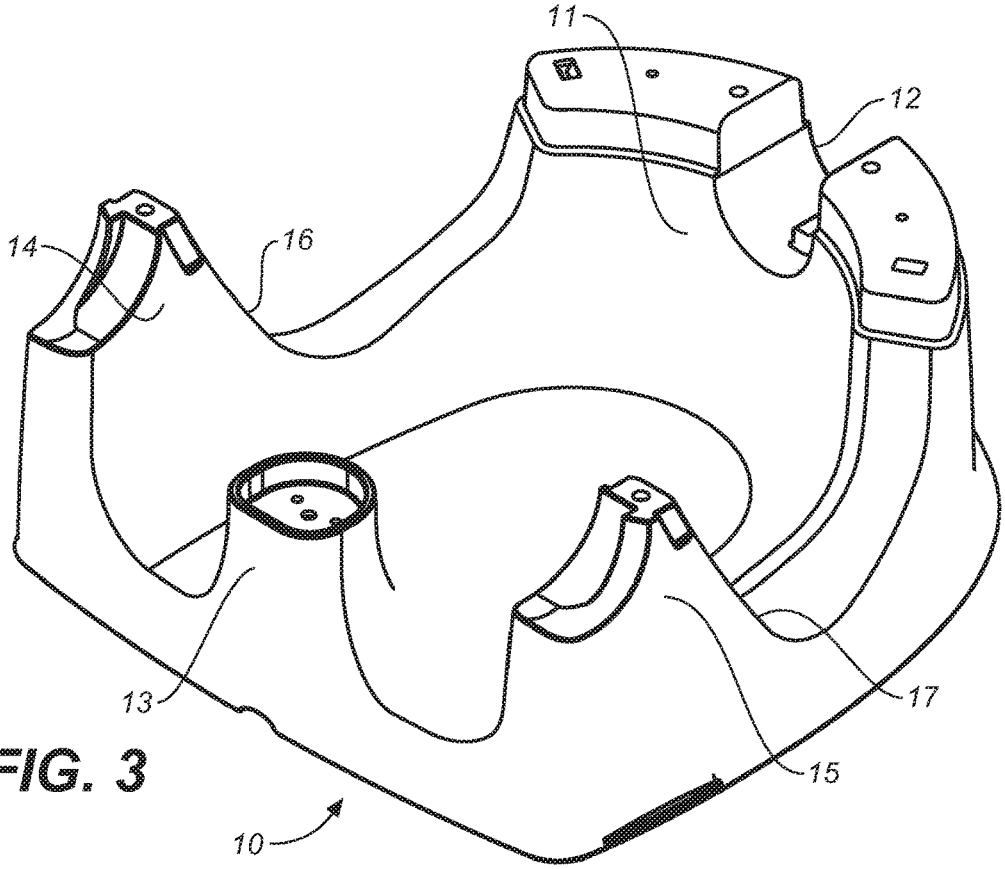
FIG. 3 is perspective views of the seat base of the embodiment shown in FIG. 1.
Figure 4:
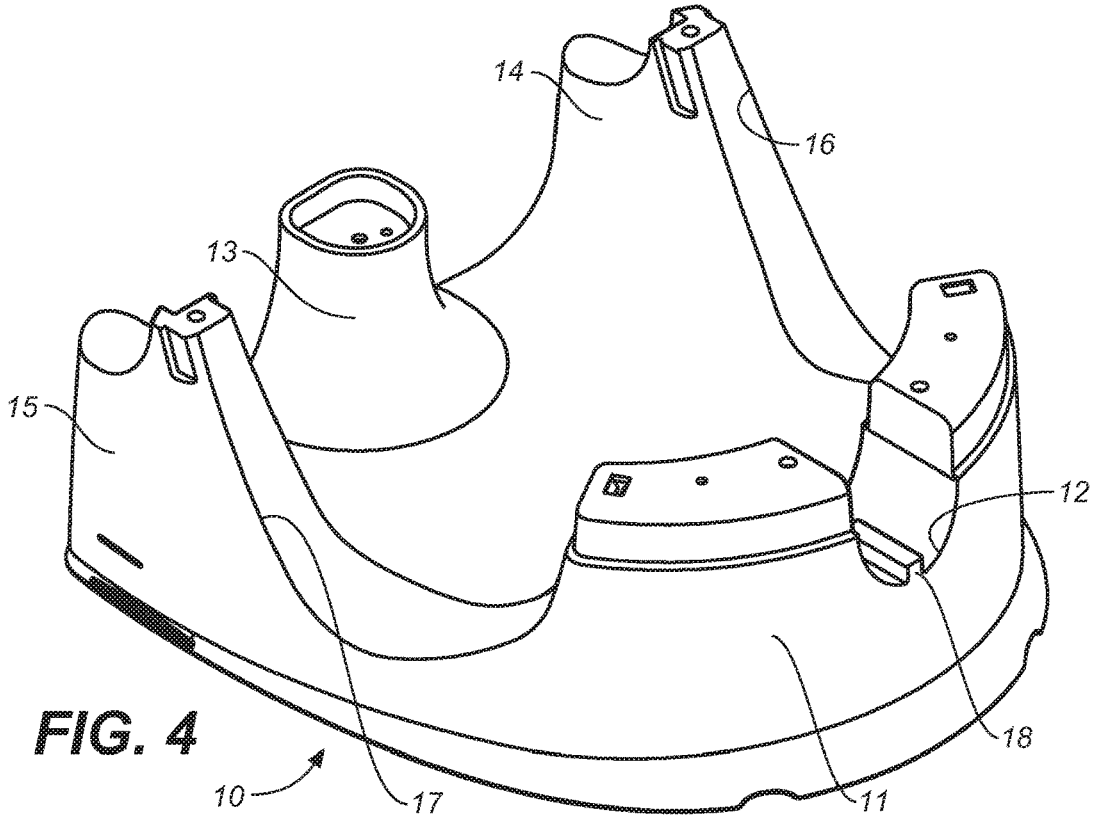
FIG. 4 is another perspective view of the seat base of the embodiment shown in FIG. 1.

The bath seat embodiment illustrated in FIG. 1 is an assembly including a seat base (10) three arm assemblies (20), (30) and (40), a seat yoke (60) and a seat top (50). FIG. 1 shows the embodiment with the arms in their extended position. FIG. 2 shows the embodiment with the proximal ends of the arms fully retracted and in which only the distal end of the arm, which terminates in the suction cup assemblies, can be seen. Referring now to FIGS. 3 and 4, the seat base (10) has a back (11) that extends upward from the bottom of the seat base and has a centrally disposed seat back channel (12) into which the rear arm assembly (20) is positioned. The front of the bath seat base has a centrally disposed support member or stanchion, (13) and side support members or side stanchions (14) and (15) on the left and right sides of the base respectively. As illustrated, the seat base also includes side cut-outs (16) and (17) but these are not required to be present. The left and right sides of the base can form a continuous surface with the seat rear. Seat base (10) is also provided with rear arm assembly stop (18) which, in the embodiment shown, is a protruding boss formed in the bottom of seat back channel (12). Seat base stop (18) prevents rear arm assembly (20) from being completely removed from the seat. Other forms of structures can be used for the same purpose, as is known by one of skill in the art.

The seat yoke (60) shown in FIG. 5 is formed with a seat yoke channel (61) running through it from one end to the other for the two side suction cup arm assemblies to rest in and slide through. Each end of seat yoke channel (61) is formed with an interiorly positioned yoke channel stop (64), only one of which is shown in FIG. 5. Yoke channel stop (64) function to stop the extension of side arms (30) and (40) at their full extension position and prevent them from coming out of the bath seat. The seat yoke also has a central hub (62) that is superposable on the seat base center stanchion (13). The yoke is secured to the seat base with a stainless steel screw (not shown) that is positioned in the yoke receiving post (63) and extends through central hub (62) and into center stanchion (13). The yoke, when secured over the center and side stanchions, creates a pair of bound openings for the child's legs to protrude through. (See FIGS. 1 and 2.)

Figure 7:
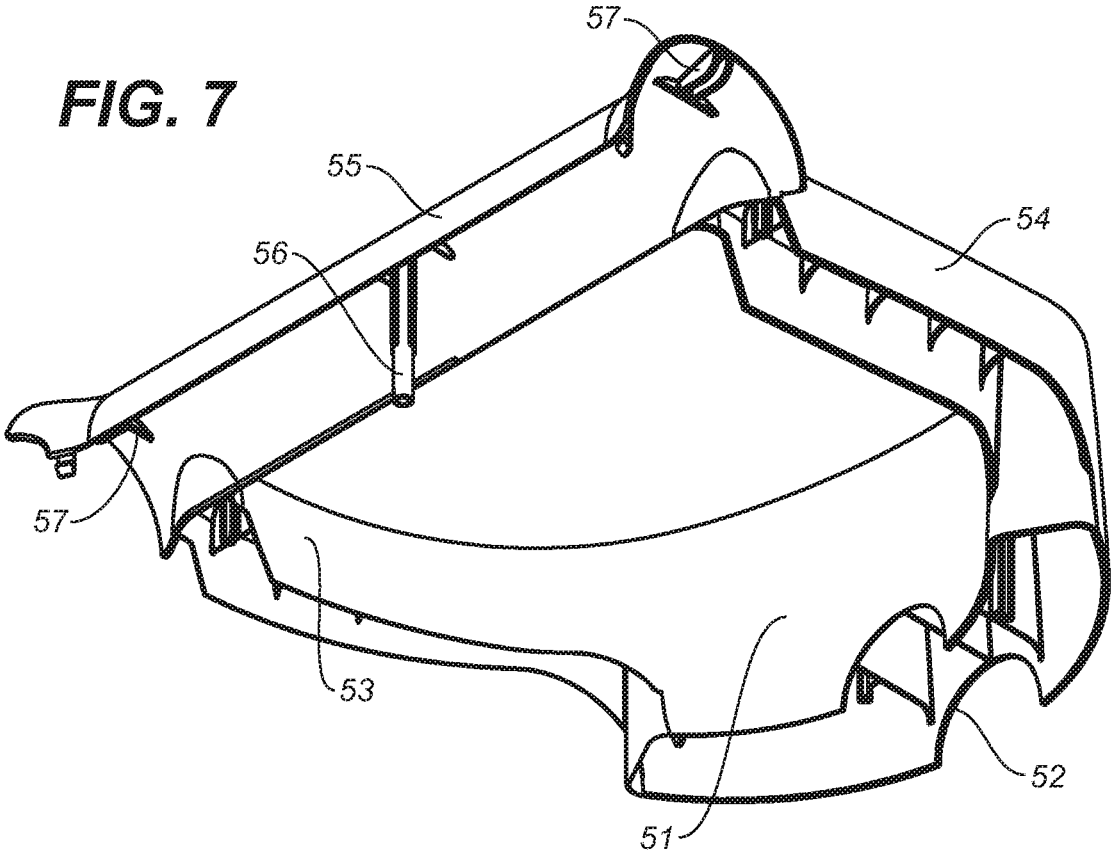
FIG. 7 is a perspective view of the underside of the seat top of the embodiment shown in FIG. 1.

The seat top (50), shown in FIGS. 6 and 7, attaches to the seat base and the seat yoke. The back (51) of the seat top is formed with a seat top channel (52) for receiving the rear suction cup arm assembly (20). When positioned atop the seat base, seat base channel (12) and seat top channel (52) form a port or bore that traps rear suctions cup arm assembly (20) but permits it to extend and retract (compare FIGS. 1 and 2). Seat top arms (53) and (54) extend from seat top back (51) around the sides to rest on and attach to front stanchions (14) and (15) of the seat base and abut yoke cap (55) (and can be formed as one integral structure or as a part separate from the seat top back and sides). Yoke cap (55) is superposed on seat yoke (60), to form a hollow tube for trapping the two front suction cup arms (30) and (40). Yoke cap 55 is form with centrally disposed, inner, stud (56) which extends downwardly and into yoke receiving post (63). The seat top is secured to the seat base and seat yoke with stainless steel screws, one screw through the base into the seat top at each of the seat base side stanchions (14) and (15) and four screws through the seat base back (11) into the seat top back (51).

Figure 9:
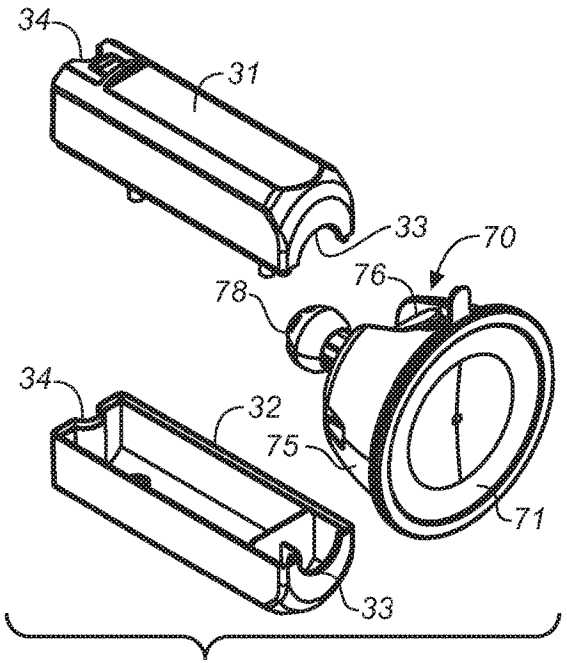
FIG. 9 is an exploded perspective view of the side arm assembly shown in FIG. 8.
Figure 9A:
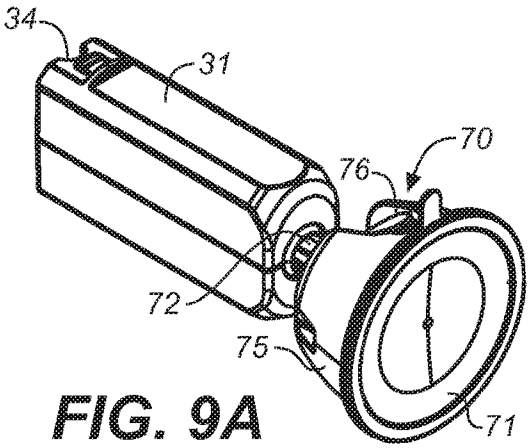
FIG. 9A is another perspective view of the side arm assembly shown in FIG. 8.
Figure 8:
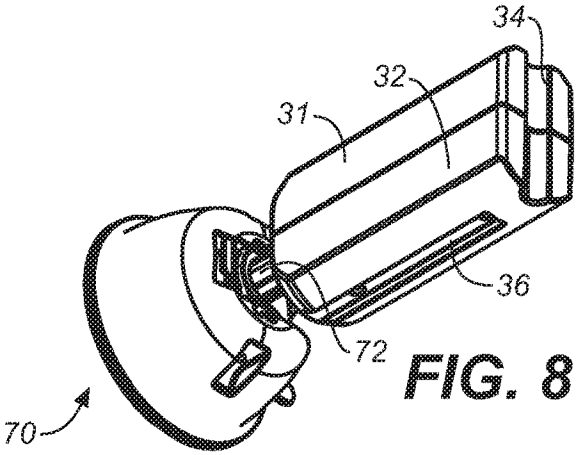
FIG. 8 is a perspective view of one of the side arm assemblies of the embodiment of the invention shown in FIG. 1.
Figure 11:
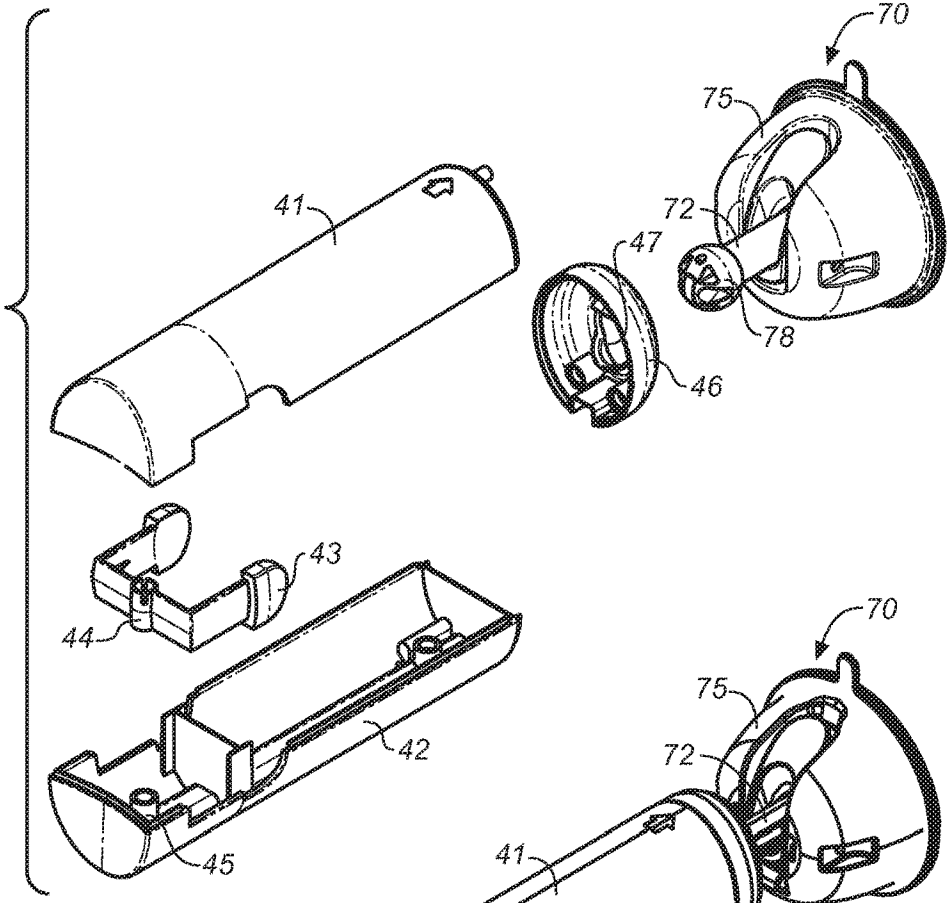
FIG. 11 is an exploded perspective view of the rear arm assembly shown in FIG. 10.
Figure 11A:
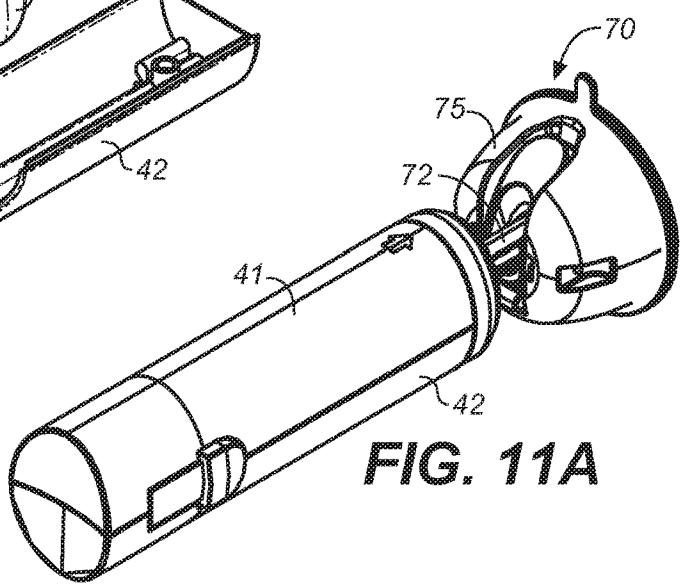
FIG. 11A is another perspective view of the rear arm assembly shown in FIG. 10.
Figure 10:
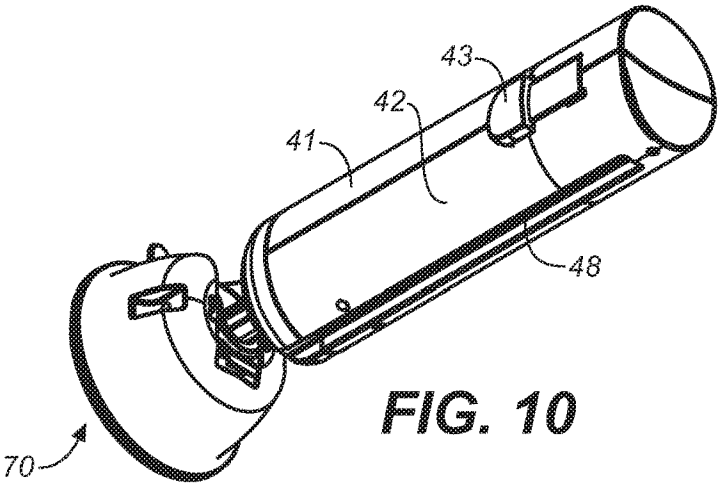
FIG. 10 is a perspective view of the rear arm assembly of the bath seat of the invention.
Figure 12:
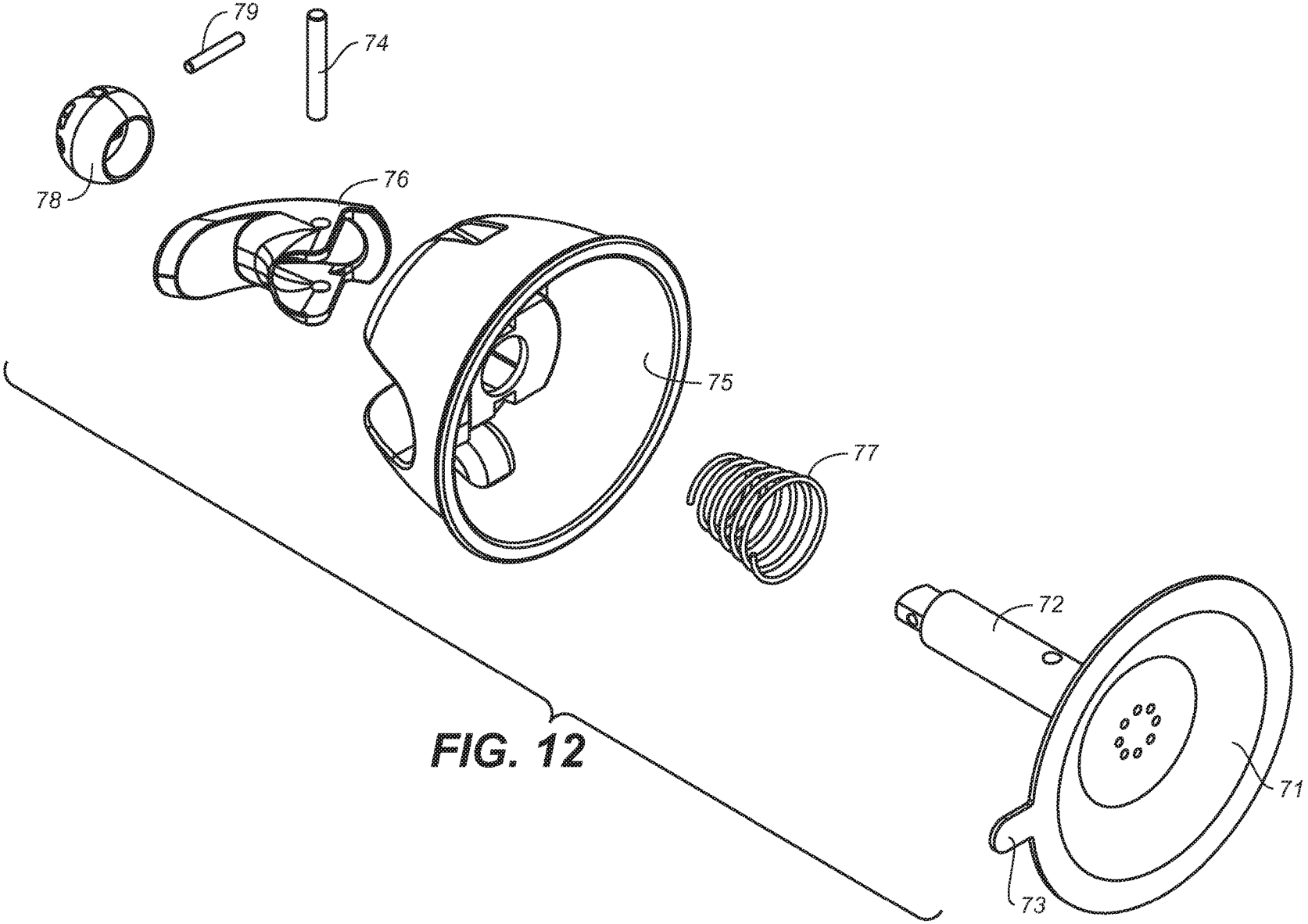
FIG. 12 is an exploded perspective view of one of the suction cup sub-assemblies of the embodiment shown in FIG. 1.
Figure 13A:
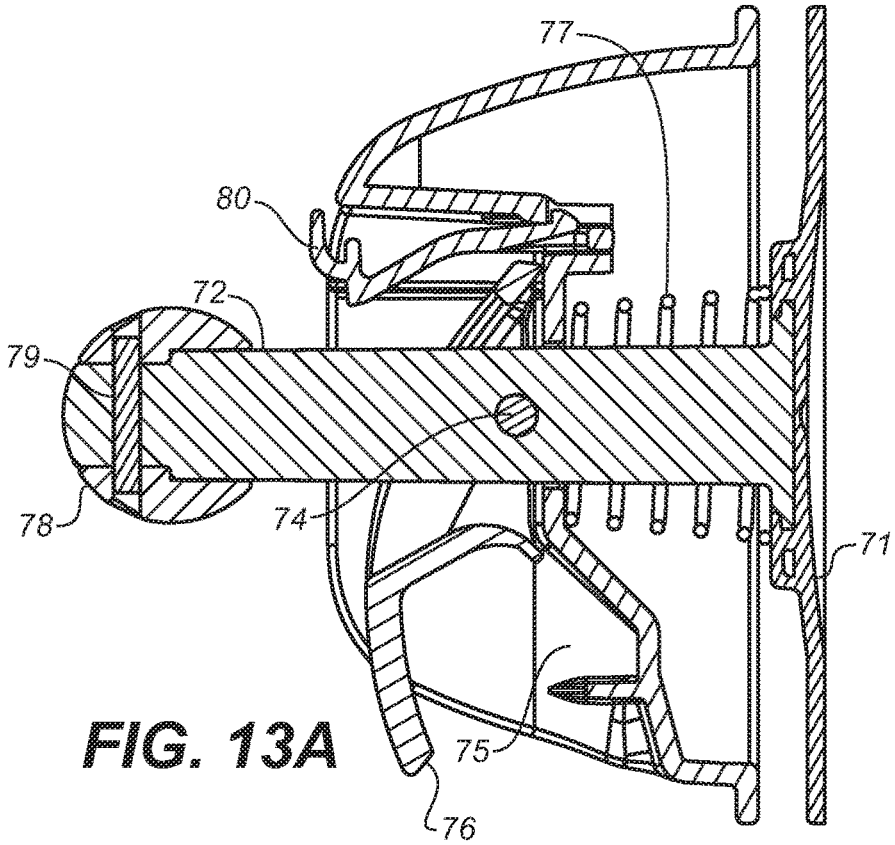
FIGS. 13A and 13B are enlarged sectional views of the suction cup sub-assembly shown in FIG. 12, taken along the line 12-12 in FIG. 12.
Figure 13B:
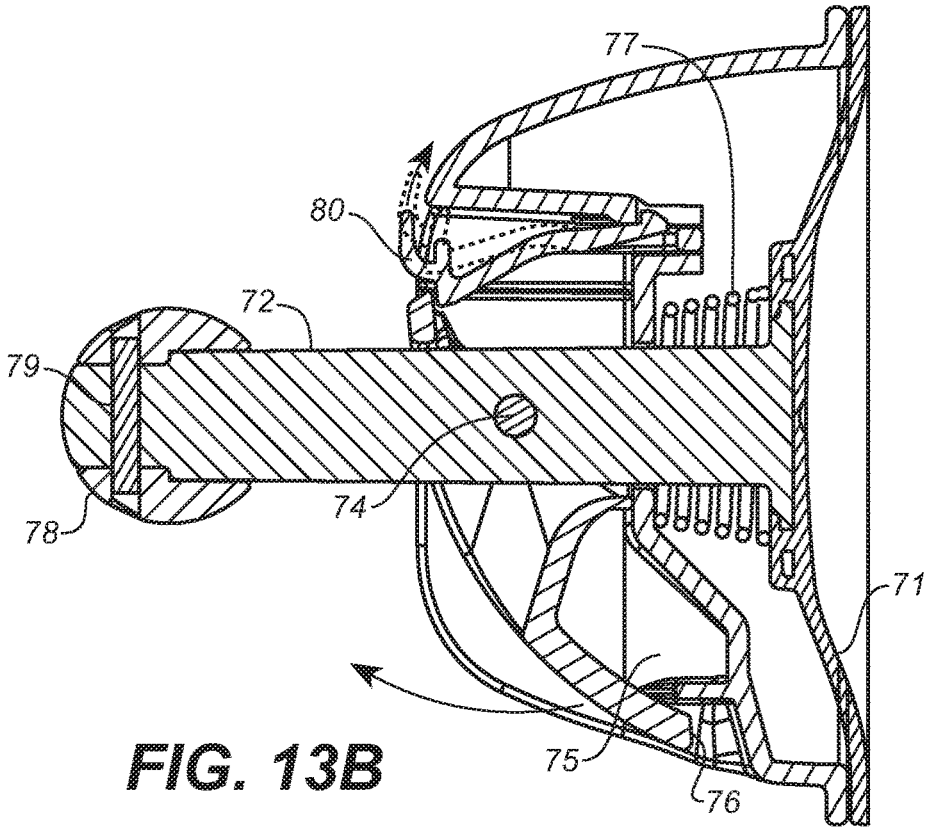
Figure 14:
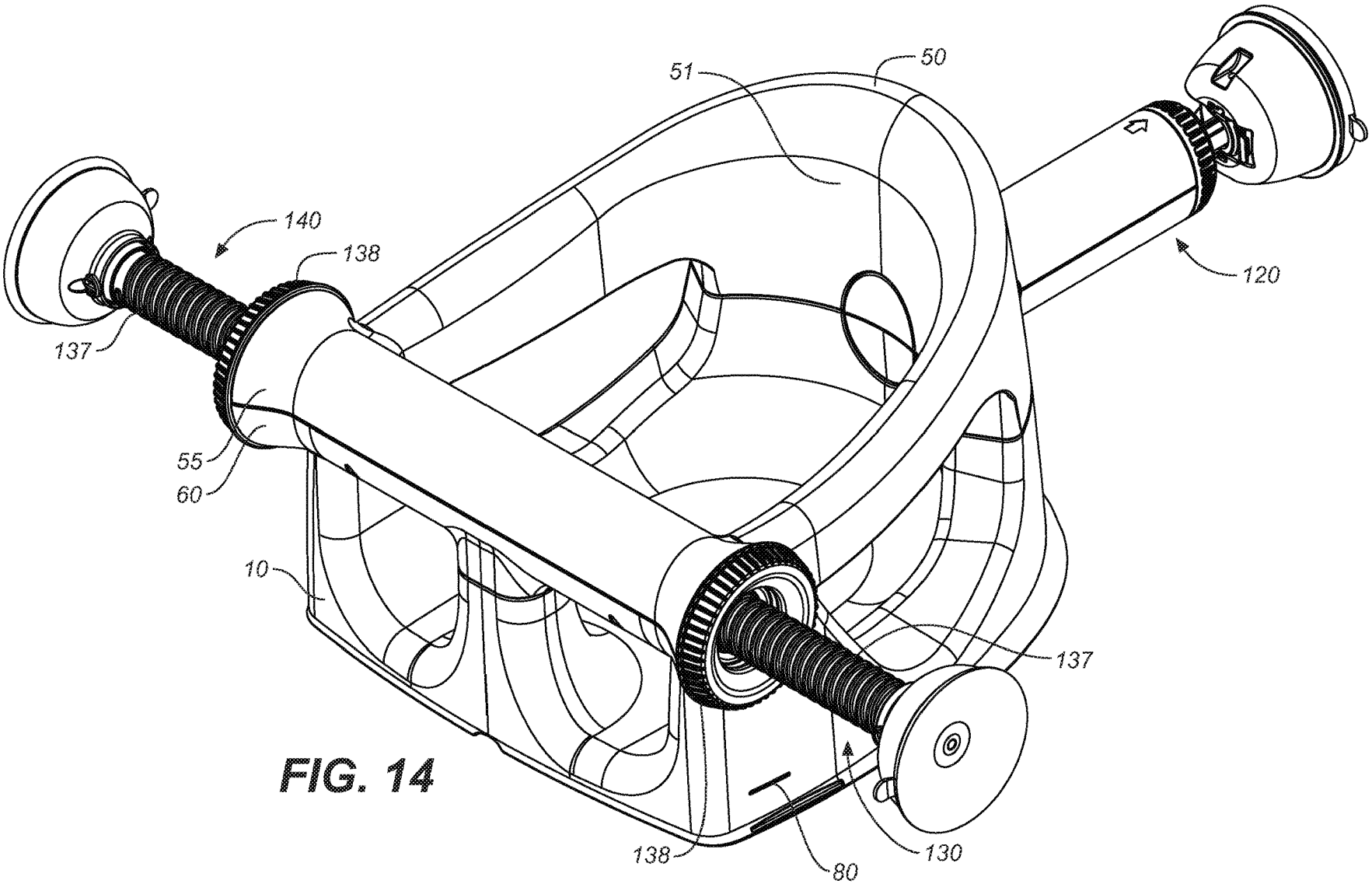
FIG. 14 is a perspective view of another embodiment of the invention with the extendable retractable arms in the extended position.
Figure 15:
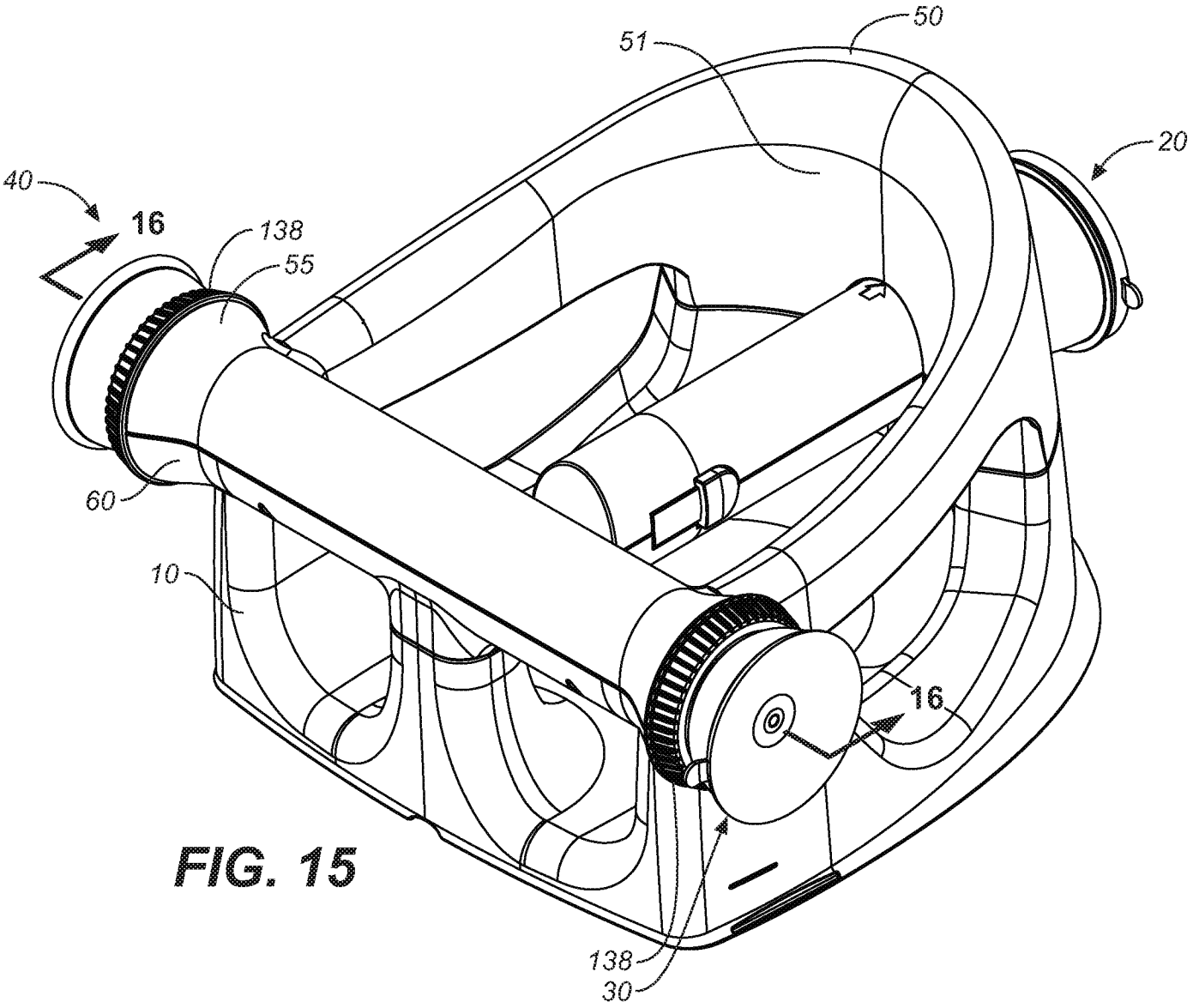
FIG. 15 is a perspective view of the embodiment shown in FIG. 14 with the same arms in the retracted position.
Figure 16:
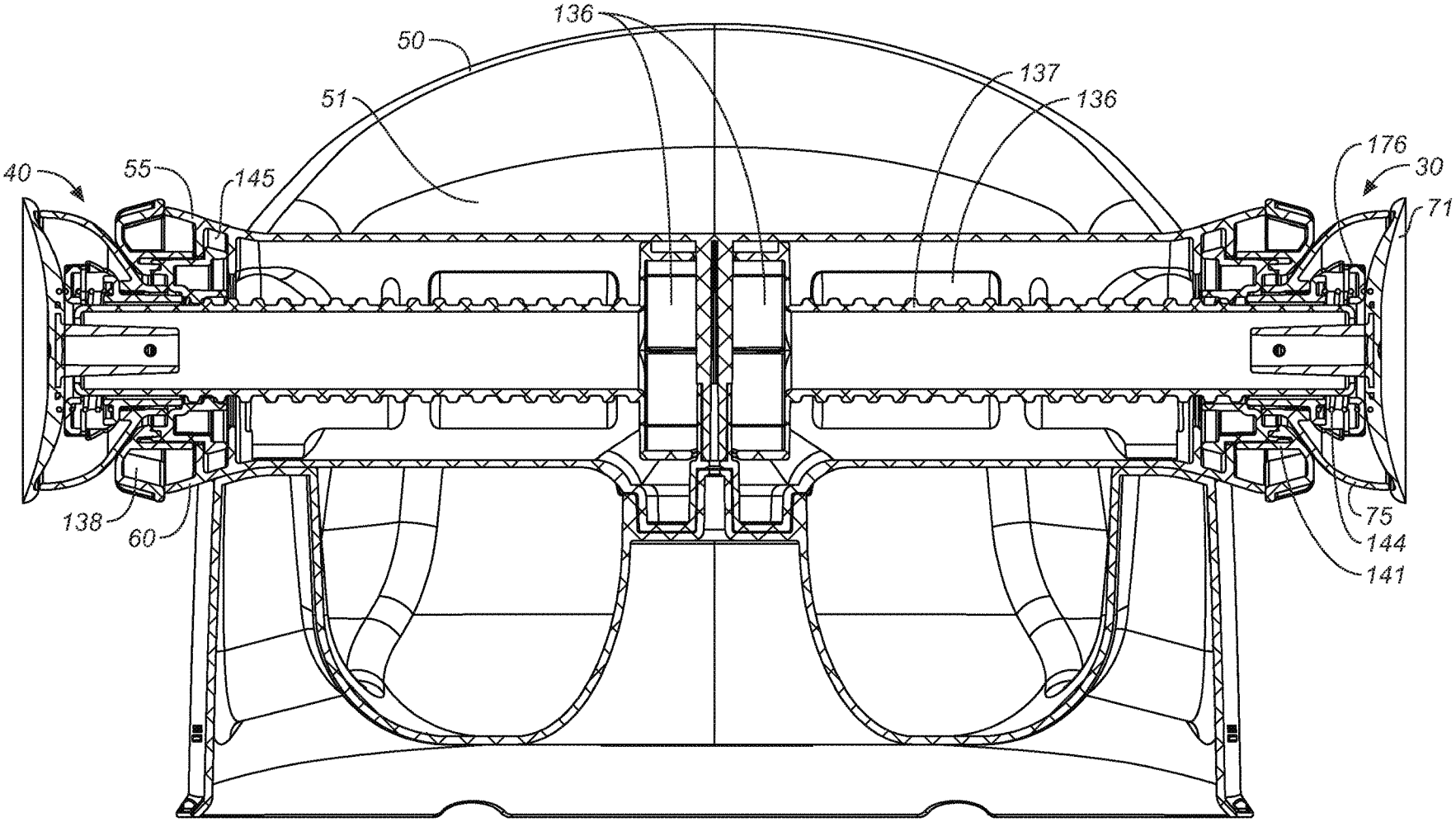
FIG. 16 is a sectional view of the embodiment shown in FIG. 14, taken along the line 15-15 in FIG. 15.
Figure 21:
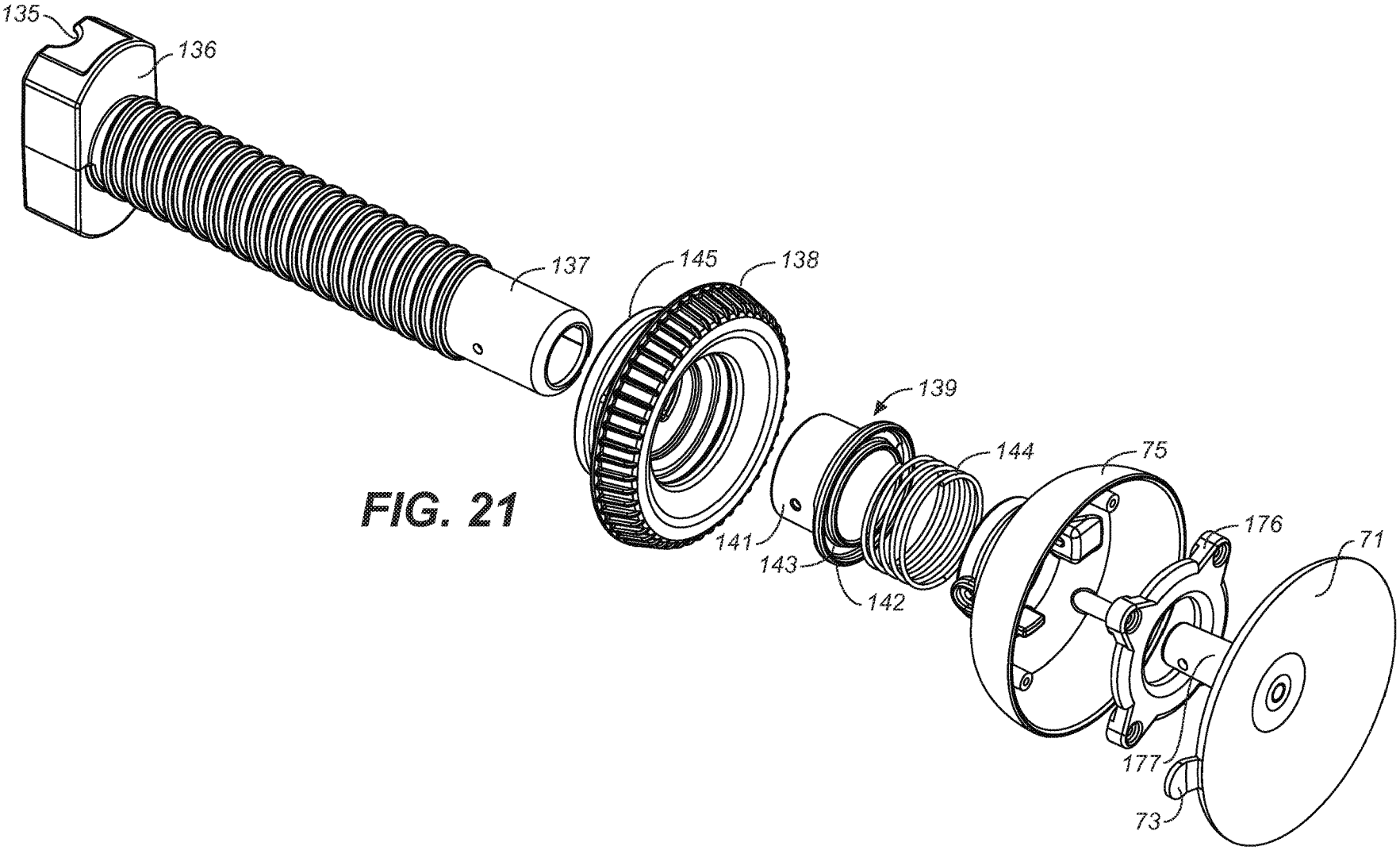
FIG. 21 is an exploded perspective view of the side arm assembly of the embodiment shown in FIG. 14.

The bath seat illustrated in FIGS. 1-13 has three arm assemblies, a rear arm assembly (20), and right and left arm assemblies (30) and (40). Right and left arm assemblies are identical in the embodiment illustrated here. Each of the suction cup arm assemblies (20), (30) and (40) includes an identical suction cup sub-assembly (70) mounted on the distal end of the arm. FIGS. 8 and 9 show the right and left arm assemblies, FIGS. 10 and 11 shown the read arm assembly and FIGS. 12 and 13 show the suction cup sub-assemblies (which are identical for each of the three arms). The suction cup sub-assemblies include a silicon suction cup (71) co-molded onto a plastic shaft (72) and an over-center locking mechanism. A release tab (73) is molded onto the side of suction cup (71). The over-center locking mechanism includes a compression spring (77), that encircles shaft (72), a suction cup arm lever (76), and a bell housing (75) having an indent (81) in the side portion thereof into which the lever sits. A first stainless steel pin (74) secures the lever to the outside of the arm bell and maintains the position of the compression spring around the shaft. With the arm lever raised, the suction cup shaft is extended; when the arm lever is depressed, the shaft is pulled upwards into the bell; this forces the suction cup against the rim of the bell and pulls the center of the suction cup into the bell creating suction for securing the arm to the bath tub walls. A molded plastic ball (78) is secured to the end of the suction cup shaft with a second stainless steel pin (79) to hold the lever and arm bell in place and to trap the suction cup arm assembly in one end of the arm as described below. A second locking lever (80) is positioned in the bell housing (75) on the side of shaft (72) opposite arm lever (76) so that it requires two hands to release the arm once it is in position and firmly held against the tub wall (see FIGS. 13A and 13B).

As best seen in FIG. 9, the two side arm assemblies (30) and (40) include mating upper arm housing (31) and lower arm housing (32), which are hollow, plastic members that are secured to each other with stainless steel screws (screws not shown) that extend through side arm screw posts (34). Upper and lower arm housings (31) and (32) when screwed together form a hollow tube terminating at the distal end in a centrally disposed hole (33) into which the shaft (72) of plastic suction cup assembly (70) extends, trapping molded plastic ball (78) inside the arm, with the remainder of the suction cup arm assembly, to wit, the lever (76), bell housing (75), and suction cup (71) outside the arm. This arrangement allows the suction cup assembly 40° of movement to accommodate variations in bathtub walls. At the opposite, proximal end, the side arm assemblies (30) and (40) are formed with an indent (34) (best seen in FIG. 8) to accommodate yoke screw receiving post (63) and permit the full retraction of each side arm assembly into the seat yoke (60). The bottom of lower arm housing (32) of each side arm is formed with side arm channel (36), which extends from the distal end of the side arm almost to the proximal end and is formed and positioned to receive seat yoke protuberances (64), and which allow the side arms to retract fully into the seat yoke (60), to extend to their fully extended position, and which prevent the side arms from coming out of the bath seat.

The rear arm assembly (20) is constructed in the same manner as the right and left arm assemblies described above, with one exception that will be discussed in connection with FIG. 11 below. Referring to FIG. 10, the rear arm assembly (20) has a rear upper arm housing (41) and a mating rear lower arm housing (42). The two housings are held together with stainless steel screws that extend through rear arm screw posts (45). The bottom of rear lower arm housing is formed with rear arm housing channel (48), which extends from the distal end of the rear arm almost to the proximal end and is formed and positioned to receive seat base stop (18), and which allows the rear arm to retract fully through the rear bore formed by seat base channel (12) and seat top channel (52).

As best seen in FIG. 11, the plastic suction cup shaft (72) of the rear arm assembly (20) is inserted into a rear cap (46) having a centrally disposed hole (47), rather than into a centrally disposed hole formed by upper arm part (31) and lower arm part (32). This arrangement traps the molded plastic ball (78) in the interior of the rear cap (46) rather than in the interior of the arm itself. Rear cap (46) is secured to the distal end of the arm assembly, composed of mating upper and lower arm housings (41) and (42), with stainless steel screws (not shown) which are inserted into rear arm screw posts (25). A U-shaped flexing release lever (43), formed with a screw hole (44), is trapped between the mating upper and lower arm housings (41) and (42) and is secured in place by means of the screw that extends through the proximally positioned rear arm screw post (45) as can be seen in FIG. 11. This rear suction cup arm assembly is trapped between the seat base and seat top as shown in FIG. 2. The arm is able to slide back and forth through the back seat due to the bore in the seat back formed by seat back channel (12) and seat top channel (52) when the seat back and seat top are put together. The rear suction cup arm assembly locks into the fully extended position shown in FIG. 1 by means of seat base stop (18) and locks via the tabs (43) on the release lever (43). To retract the arm, the release lever tabs are depressed and the arm is then slide toward the front of and into the seat as shown in FIG. 2. Because the arm blocks the seat when retracted, the seat cannot be used without fully extending the rear arm.

The right and left side arm assemblies are trapped in the hollow tube formed by the mating of the seat yoke channel (60) with seat top channel (52) and slidably extend to their fully extended position and retract to their fully retracted position by means of seat yoke protuberances (64) and side arm channels (36). The right and left side arm assemblies move independently of one another, sliding in and out through the yoke channel (61). And these right and left arm assemblies move independently of the rear arm assembly so that each of the three arm assemblies move independently of each other. One of skill in the art understands that it is not required that three arm assemblies must be employed—more than three or less than three may be employed as long as the number employed render the structure stable in a water-filled bath tub. Further, the suction cup sub-assembly described herein is only one of a number of suction cup sub-assemblies that may be employed. Alternatives to the suction cups described herein include those described in U.S. Pat. Nos. 8,104,809; 7,661,638; and 7,455,269 and in UK Patent Nos. GB2463325 and GB2455616. Likewise, the general aspect of the bath seat herein described is only exemplary. One of skill in the art would readily understand how to modify the known bath seats, for example those disclosed in U.S. Pat. Nos. 5,687,433 and 5,010,606 to include the rigid extendable and retractable arm assemblies described herein to stabilize the seat and render it safe for bathing an infant.

To install this embodiment of the seat, all the suction cup arm levers are placed in the open position by raising suction cup arm lever 76. The seat is placed in the tub and the rear suction cup arm assembly is extended fully to the position shown in FIG. 1. The seat is then slide back until the rear suction cup is against the back wall of the tub. The rear suction cup arm lever is then depressed to secure the seat to the back wall of the tub. Next the right and left side arm assemblies are extended until the suction cup of each assembly is against the side walls of the tub and the suction cup arm lever of each is depressed to secure the seat to the tub side walls. The tub can then be filled to the fill line indicator, 40, that is molded onto the outer side of the seat base.

To remove the bath seat from the tub, one would release each of the suction cup arm levers and pull on the release tab molded onto each suction cup to release the suction. The side arm assemblies are then slid back into the yoke, and the rear arm assembly is slid back into the seat the two catches on the rear arm and slide b into the seat.

Another embodiment of the bath seat of the invention is shown in FIGS. 14 to 21. In this embodiment the rigid side arms engage with the seat yoke assembly and extend and retract by means of a hollow threaded screw tube (137) rather than the slidable engagement with the seat yoke assembly as shown in the first embodiment. In a further modification, the rear arm assembly may be formed in the same manner as in this alternate embodiment. Alternatively, the rear arm assembly can be formed with its proximal end as in the first embodiment, that is to say, with the slidable portion of the arm, and with its distal, suction cup end, with a threaded screw tube within the bell housing. In this embodiment, side arms 130 and 140 are formed at their proximal ends with base (136) that is formed at one end with indent 135 which seats against the yoke screw tube receiving post (63) as in the first embodiment, and which is affixed at its opposite end to the proximal end of screw tube (137). The distal end of screw tube (137) is unthreaded and grip nut (138) has a centrally disposed aperture that is formed with threads that mate with the threads on screw tube (137). By this means screw tube (137) is threaded through the grip nut (138). In turn the grip nut is trapped in the hollow tube formed by the mating of the seat yoke channel (60) with seat top channel (55), the interiors of which are formed with ribs (64) that trap the grip nut in place, allowing it to spin but not extend or retract. Seated in the threaded aperture of the grip nut and mounted on the distal, unthreaded end of screw tube (137) is lock indicator (139). Lock indicator (139) is hollow and is formed with a stem (141) that terminates in an annular boss (142). Annular boss (142) is formed with an annular channel (143) into which compression spring (144) is seated. The top of bell housing (75) is positioned over the spring to complete the arm assembly. Grip nut (138) is formed with a grip nut stem (145) which is interiorly threaded and formed with an exterior that is trapped, by means of an annular flange, by the interior yoke channel ribs (64) formed in the hollow tube created by the mating of the seat yoke channel (60) with seat top channel (55). Because the grip nuts are held in place by the seat yoke ribs (64) and do not extend or retract, when the grip nut is turned, the threaded screw tube (137) retracts or extends. Lock indicator stem (141) is made of a different color, for example red, and indicates when the suction cup is engaging the tub wall with the proper pressure. When the threaded screw tube has extended to the proper position making contact with the tub wall, lock indicator stem (141) will no longer be seen. When the suction cup is not fully compressed against the tub with the proper amount of pressure to ensure the seat stays in place, the red cap stem is exposed and the seat is not secured properly. When the suction cup is fully compressed against the tub wall, the red lock indicator stem is covered by the bell housing and the product is secure against the tub wall.

The right and left side arm assemblies move independently of one another, and are screwed in and out through the yoke channel (61). These right and left arm assemblies move independently of the rear arm assembly so that each of the three arm assemblies move independently of each other. The rear arm assembly may be the assembly shown in the first embodiment or it may be identical to the right and left arm assemblies shown in this embodiment.

The suction cup assemblies shown in this embodiment also differ from the assemblies shown in the first embodiment. In this embodiment, the ball joint may be eliminated. As best see in FIG. 21, inside bell housing 75 there is centrally positioned spring cup (176) which seats the suction cup within the housing in the proper position. On the side opposite the side of the suction cup that makes contact with the tub wall is suction cup stem (177) which extends through the bell housing, the interior of the compression spring, and into lock indicator (139) and is held in place by a pin (not shown) that extends through the unthreaded portion of the screw tube and also through lock indicator stem (141). In this construction, there is enough play inherent in the structure due to the compression spring to allow the suction cup to move up and down and side to side at little, just enough so that when the arm is extended to make contact with the bath tub side or back wall the suction cup can conform to the tilt of the wall and form a good seal.

To install this embodiment of the seat, when all of the arm assemblies are of the screw tube type, all arm assemblies are moved so that they are in the retracted position. When there is a rear assembly of the screw tube type, the lock indicator may optionally be eliminated from the construction. The seat is placed in the tub and the rear suction cup arm assembly is extended fully to the position shown in FIG. 1. The seat is then slide back until the rear suction cup is against the back wall of the tub and the suction cup forms a good seal with the tub wall. The lock indicator (139), if present, should not be seen. If it is seen the screw tub has not been extended to its appropriate length. Once the rear arm assembly has been extended fully to its appropriate position and the suction cup has formed a good seal with the back tub wall, the right and left side arm assemblies are extended until the suction cup of each assembly is against the side walls of the tub and the lock indicator can no longer be seen. The right and let side arm assemblies now secure the seat to the tub side walls. The tub can then be filled to the fill line indicator, 40, that is molded onto the outer side of the seat base.

To remove the bath seat from the tub, one would release each of the suction cup arm assemblies by turning the grip nut in the direction opposite to the direction that caused the screw tubes to extend. At or near the same time, the release tab on the suction cup is pulled to release the suction. Turning the grip nut retracts the arm assemblies. The side arm assemblies are then retracted back into the yoke, and the rear arm assembly is screwed back into the seat area where the child or infant would be sitting or if the rear arm assembly is of the slidable type, then the assembly is simply slide back into the seat area. If the rear arm assembly is of the type that has both slidable and screwable portions, once the suction cup is released, the assembly can be slid back into the seat area.

When the bath seat has arm assemblies composed of a combination of the two embodiments disclosed in detail herein, the instructions for extending and retracting the arm assemblies will comprise a combination of the directions herein provided.

Another alternative to the suction cup assemblies described or referenced herein is to replace the suction cup portion of one or more arm assemblies with a double-sided adhesive material that is attached on one side to a plate or rigid disk that takes the place of the suction cup. When the rigid arms are extended to contact the tub wall, the adhesive material secures the arms and prevents movement of the bath seat. In this embodiment, the stabilizing arms are engagable with the tub wall by means of adherence instead of by mean of suction. The skilled artisan will know the appropriate reusable, double-sided, water-impermeable, adhesive that will maintain its stickiness, i.e. its adhesive qualities, under water, for example, those sold by the Nitto Company. When the seat is ready to be removed from the tub, a release mechanism on the plate can be used to allow the plate to remain in place on the tub wall. A further alternative is to have the extendable and retractable arm end in a plate able to engage by means of adherence to a reusable, double-sided, water-impermeable adhesive that is place on the tub wall rather than the plate.

Particular exemplary embodiments of the invention have been described in detail. These exemplary embodiments are illustrative of the inventive concept recited in the following claims and are not limiting of the scope or spirit of the invention as contemplated by the inventors. References to patents and other literature cited herein are hereby incorporated by reference for the substance of what they disclose.

We claim:

1. A bath seat for use in a bath tub, said bath seat comprising:

a seat base having a plurality of stanchions circumferentially disposed and extending upwardly from said base;

a seat top disposed on said stanchions to form at least two apertures permitting legs of a bath seat user to extend therethrough, said seat top including a seat top channel;

a yoke assembly attached to said seat top, said yoke assembly including a seat yoke channel that after being mated with said seat top channel forms a hollow tube; and a plurality of spaced-apart, rigid, extendable and retractable, stabilizing arms retained by said seat yoke assembly, each arm having a suction cup at or near one end thereof engageable by means of suction with a wall of said bath tub, at least two of said stabilizing arms being side arms, each side arm having a threaded screw tube and a corresponding threaded grip nut, each threaded screw tube at least partially disposed in said hollow tube and threaded through its corresponding grip nut, wherein threads of said grip nut mate with threads of said screw tube and enable said screw tube to extend or retract based on a direction of movement of said grip nut.

2. The bath seat according to claim 1 wherein said stabilizing arms are independently extendable and retractable.

3. The bath seat according to claim 1 wherein said plurality of stabilizing arms comprises three stabilizing arms.

4. A bath seat for use in a bath tub, said bath seat comprising:

a seat base having at least one stanchion circumferentially disposed and extending upwardly from said base;

a seat top disposed on said at least one stanchion to form at least two apertures permitting legs of a bath seat user to extend therethrough;

a yoke assembly attached to said seat top, said yoke assembly including a seat yoke channel that after being mated with said seat top forms a hollow tube; and three spaced-apart, rigid, independently extendable and retractable, stabilizing arms retained by said seat yoke assembly, each arm having a suction cup at or near one end thereof engageable by means of suction with a wall of said bath tub, at least two of said arms having a threaded screw tube and a corresponding threaded grip nut, each threaded screw tube being (1) at least partially disposed in said hollow tube and (2) threaded through its corresponding grip nut, wherein threads of said grip nut mate with threads of said screw tube and enable said screw tube to extend or retract based on a direction of movement of said grip nut.

5. A bath seat comprising:

a seat base having an upwardly extending back and sides, said back having at its top one or more upward facing channels or grooves at said top thereof that extends perpendicularly from an interior of said seat base to an exterior of said seat base, and a front of said seat base having a center stanchion;

a seat yoke disposed on a top of said center stanchion and formed to rest upon a top of said seat base sides;

a seat top having a downwardly extending back, said back having one or more downward facing channels or grooves superposed on said seat base channels to form one or more rear apertures, a pair of arms extending from said back around each side of said seat and terminating in a downward facing channel superposed on said seat yoke to form a bore, said bore extending across a front of said seat; and a plurality of extendable and retractable arms, one end of each arm being positioned at least partially within said bore or said rear apertures, each arm terminating in a pivotable suction cup at its other end, at least two of said arms having a threaded screw tube and a corresponding threaded grip nut, each threaded screw tube being (1) disposed in said bore and (2) threaded through its corresponding grip nut, wherein threads of said grip nut mate with threads of said screw tube and enable said screw tube to extend or retract based on a direction of movement of said grip nut.

6. The bath seat according to claim 5 wherein at least one of said suction cups is attached to said arm by a ball joint.

7. The bath seat according to claim 6 wherein at least one of said suction cups is spring-loaded.

8. The bath seat according to claim 5 wherein said plurality of arms equals three.

9. A bath seat usable in a bathtub, the bath seat comprising:

a base;

a top portion;

a plurality of support members extending between said base and said top portion; and a plurality of rigid, extendable and retractable, stabilizing arms retained by said bath seat, each arm having a suction cup at or near one end thereof engageable by means of suction with a wall of said bathtub, at least two of said stabilizing arms being side arms, each side arm having a threaded screw tube and a corresponding threaded grip nut, each threaded screw tube being threaded through its corresponding grip nut allowing said screw tube to be extended or retracted based on a direction of movement of said grip nut.

10. The bath seat according to claim 9 wherein at least one suction cup is connected to a stabilizing arm by a pivot joint.

11. The bath seat according to claim 10 wherein said pivot joint is a ball joint.

12. The bath seat according to claim 9 wherein at least one suction cup is spring-loaded.

13. The bath seat according to claim 9 wherein the plurality of stabilizing arms equals three.

14. The bath seat according to claim 13 wherein each suction cup is connected to its respective stabilizing arm by a ball joint.

15. The bath seat according to claim 13 wherein each suction cup is spring-loaded.

16. The bath seat according to claim 9 wherein each suction cup is spring-loaded and connected to its respective stabilizing arm by a ball joint.

17. A bath seat usable in a bathtub, the bath seat comprising:

a base;

a top portion; and a plurality of support members extending between said base and said top portion; and a plurality of rigid, extendable and retractable, stabilizing arms retained by said bath seat, each arm having a suction cup at or near one end thereof engageable by means of suction with a wall of the bathtub, at least two of said stabilizing arms having a threaded screw tube and a corresponding threaded grip nut, each threaded screw tube being (1) disposed in a hollow tube associated with said top portion and (2) threaded through its corresponding grip nut where threads of said grip nut mate with threads of said screw tube and enable said screw tube to extend or retract based on a direction of movement of said grip nut.

18. The bath seat according to claim 17 wherein each suction cup is spring-loaded and connected to its respective stabilizing arm by a ball joint.

19. The bath seat according to claim 18 where said plurality of stabilizing arms equals three.

* * * * *